US011319140B2

(12) United States Patent
Modha et al.

(10) Patent No.: US 11,319,140 B2
(45) Date of Patent: May 3, 2022

(54) GLOVE DISPENSING ASSEMBLY

(71) Applicant: O&M Halyard, Inc., Mechanicsville, VA (US)

(72) Inventors: Shantilal Hirjibhai Modha, Milton, GA (US); Tantima Saelim, Songkhla (TH); Khoa Tuan Lien, Alpharetta, GA (US)

(73) Assignee: O&M Halyard, Inc., Mechanicsville, VA (US)

( * ) Notice: Subject to any disclaimer, the term of this patent is extended or adjusted under 35 U.S.C. 154(b) by 0 days.

(21) Appl. No.: 16/529,079

(22) Filed: Aug. 1, 2019

(65) Prior Publication Data

US 2019/0352084 A1 Nov. 21, 2019

Related U.S. Application Data

(62) Division of application No. 15/570,064, filed as application No. PCT/US2016/026371 on Apr. 7, 2016, now Pat. No. 10,414,577.

(60) Provisional application No. 62/251,387, filed on Nov. 5, 2015, provisional application No. 62/155,238, filed on Apr. 30, 2015.

(51) Int. Cl.
*B65D 83/08* (2006.01)
*B65D 5/72* (2006.01)

(52) U.S. Cl.
CPC ..... *B65D 83/0817* (2013.01); *B65D 5/724* (2013.01)

(58) Field of Classification Search
CPC ..... B65D 25/0102; B65D 83/0817; B65D 5/724
USPC .... 221/197, 46, 63, 36, 34, 35, 52, 254, 59, 221/279, 58, 65, 45
See application file for complete search history.

(56) References Cited

U.S. PATENT DOCUMENTS 281,354 A 7/1883 Edwards
466,792 A 1/1892 Lindemeyer
(Continued)

FOREIGN PATENT DOCUMENTS

CN 201890395 U 7/2011
DE 20316963 U1 3/2005
(Continued)

OTHER PUBLICATIONS

International Search Report for PCT/US2016/026371, dated Aug. 11, 24016. 4 pages.

*Primary Examiner* — Rakesh Kumar
(74) *Attorney, Agent, or Firm* — Dority & Manning, P.A.

(57) ABSTRACT

The present disclosure is directed to a dispensing assembly. The dispensing assembly includes a container having a plurality of exterior panels that define an internal chamber. The exterior panels include at least opposing side panels and a top panel having an opening configured to dispense a plurality of articles therethrough. The dispensing assembly also includes an article dispensing component housed within the internal chamber that includes a base panel arranged with the top panel of the container so as to form an article storage area. The article storage area is configured to receive the plurality of articles. The base panel is biased towards the top panel via at least one flexible member that is secured to at least one of the opposing side panels of the container. Thus, the flexible member is configured to allow movement of the base panel towards to the top panel as each article is dispensed from the opening.

7 Claims, 11 Drawing Sheets

(56) References Cited

U.S. PATENT DOCUMENTS 537,613 A * 4/1895 Lucas ..... B65D 83/0817 221/58
1,209,054 A * 12/1916 Skall ..... A47K 10/422 221/52
1,218,196 A * 3/1917 McCorkindale ..... A47K 10/422 221/52
1,593,532 A * 7/1926 Hansen ..... A47K 10/427 221/52
1,707,578 A * 4/1929 Shaffer ..... A47K 10/427 221/62
2,011,403 A 8/1935 Gessler
2,267,305 A 12/1941 Natwick et al.
2,509,841 A * 5/1950 Rose ..... B42F 5/005 283/40
2,634,855 A * 4/1953 Mandel ..... B65D 83/0817 221/59
2,937,742 A 5/1960 Michiel
3,197,062 A 7/1965 Day et al.
3,202,316 A * 8/1965 Silver ..... B65D 83/0817 221/59
3,313,583 A * 4/1967 Turkington ..... A47K 10/24 312/61
3,603,452 A * 9/1971 Singer ..... A47K 10/421 206/761
3,647,114 A * 3/1972 Bleuer ..... B65D 83/0817 221/59
3,746,152 A 7/1973 Allen
3,765,565 A * 10/1973 Fietzer ..... A47K 10/427 221/46
3,942,682 A 3/1976 McKay
4,158,412 A 6/1979 Wysocki
4,281,259 A 7/1981 Ozawa
4,407,473 A 10/1983 Ilowe, Jr.
4,616,767 A * 10/1986 Seido ..... A47K 10/421 221/58
4,913,312 A 4/1990 Boutin
4,997,105 A * 3/1991 Fischer ..... B65D 5/16 206/278
5,161,702 A 11/1992 Skalski
5,197,631 A 3/1993 Mishima
5,363,985 A * 11/1994 Cornell ..... B42D 5/005 221/46
5,507,428 A 4/1996 Robinson, Jr. et al.
5,570,808 A * 11/1996 Tassoni ..... A47F 1/08 221/311
5,765,718 A * 6/1998 Grasso ..... A47K 10/3818 221/1
5,803,345 A 9/1998 Jones et al.
5,897,023 A 4/1999 Lee
5,921,434 A 7/1999 Hollander et al.
5,979,700 A * 11/1999 Suess ..... B65D 83/0817 221/52
5,992,683 A * 11/1999 Sigl ..... A47K 10/422 221/52
6,112,936 A 9/2000 Arizmendi
6,189,730 B1 2/2001 McClymonds
6,488,175 B2 12/2002 Shiffler et al.
6,543,642 B1 * 4/2003 Milliorn ..... B65D 77/06 221/46
6,749,084 B2 6/2004 Thompson
6,886,714 B2 5/2005 Kruchoski et al.
6,997,310 B1 * 2/2006 Fenley ..... B42F 7/145 206/214
7,481,313 B1 1/2009 Kramedjian et al.
7,699,189 B2 * 4/2010 Tramontina ..... B65D 83/0817 221/36
7,708,154 B2 * 5/2010 Lang ..... A47F 1/126 211/59.3
7,735,679 B2 6/2010 Liu et al.
7,806,291 B2 * 10/2010 Anderson ..... A47K 10/3818 221/33
8,646,653 B2 2/2014 Lien et al.
8,650,842 B2 2/2014 Stollery et al.
9,451,851 B1 * 9/2016 Lukawski ..... A47K 10/422
2003/0116580 A1 * 6/2003 Baughman ..... A61B 42/40 221/45
2003/0201276 A1 * 10/2003 Fuller ..... B65D 83/0805 221/155
2004/0169047 A1 * 9/2004 Behnke ..... B65D 83/0817 221/45
2006/0273102 A1 * 12/2006 Wieser ..... A47K 10/422 221/59
2007/0210096 A1 * 9/2007 Ellswood ..... B65D 83/0805 221/34
2007/0215628 A1 * 9/2007 Tramontina ..... B65D 83/0817 221/35
2007/0215630 A1 9/2007 Tramontina
2008/0164276 A1 7/2008 Kan
2008/0314777 A1 * 12/2008 Foster ..... G09F 3/20 206/223
2009/0057172 A1 3/2009 Hungler et al.
2009/0090736 A1 4/2009 Cowell et al.
2012/0037577 A1 * 2/2012 Wootten, Jr. ..... A47F 7/18 211/45
2012/0118905 A1 5/2012 Lindbergh
2012/0279981 A1 11/2012 Thomas et al.
2012/0298689 A1 * 11/2012 Cohen ..... A61B 42/40 221/197
2013/0164729 A1 * 6/2013 Rappa ..... G09B 19/02 434/365
2013/0186800 A1 * 7/2013 Lien ..... B65D 5/542 206/526
2013/0239449 A1 * 9/2013 Heinrichs ..... G09F 3/04 40/665
2015/0232216 A1 8/2015 Stollery et al.
2018/0105348 A1 * 4/2018 Modha ..... B65D 83/0817
2018/0162628 A1 * 6/2018 Modha ..... B65D 83/0817

FOREIGN PATENT DOCUMENTS

DE 102004015576 A1 11/2005
DE 102005056162 A1 7/2007
GB 2385314 A 8/2003
GB 2467234 A 7/2010
GB 2489326 A * 9/2012 ..... B65D 5/5213
GB 2489326 A 9/2012
GB 2495023 A 3/2013
GB 2503677 A 1/2014
GB 2519839 A 5/2015
JP S62271870 A 11/1987
JP H07291372 A 11/1995
JP H09315469 A 12/1997
NL 6703027 A 5/1968
WO WO 03/078272 A1 9/2003
WO WO 2006/000242 A1 1/2006
WO WO 2014/140573 A1 9/2014

* cited by examiner

GLOVE DISPENSING ASSEMBLY

RELATED APPLICATIONS

The present application claims priority to U.S. Provisional Application Ser. No. 62/155,238 filed on Apr. 30, 2015, U.S. Provisional Application Ser. No. 62/251,387 filed on Nov. 5, 2015, and International Application Number PCT/US2016/026371 filed on Apr. 7, 2016, and claims priority and is a divisional of U.S. application Ser. No. 15/570,064 filed on Oct. 27, 2017, which are incorporated herein in their entirety by reference hereto.

FIELD OF THE INVENTION

The present invention relates in general to a dispensing assembly, and more particularly to a glove dispensing assembly for disposable articles and methods of manufacturing same.

BACKGROUND OF THE INVENTION

A variety of single use, disposable products such as gloves, facemasks and the like are packaged in dispensing cartons. These dispensing cartons frequently have an opening or dispensing orifice cover.

Exemplary cartons or carton modifications for dispensing a variety of products including surgical gloves, tissues, dust mitts, and disposable gloves, are described at, for example:

U.S. Pat. No. 3,746,152 for "Surgical Glove Carton" issued to Allen on Jul. 17, 1973, describes a flat, sterilizable carton that is configured to store a pair of surgical gloves for an extended period in sterile condition and then "snap open" to a flat configuration and also lock in the flat configuration to present the surgical gloves to a user on a sterile field of cardboard.

U.S. Pat. No. 6,112,936 for "Medical Glove Dispensing Enclosure" issued to Arizmendi on Sep. 5, 2000, describes an envelope made of tubular net material that is stretched around a glove dispensing box or the like such that a sphincter closure in the net material is located over an opening in the dispensing box. The sphincter closure is made by cutting a hole in the net material and weaving an elastic band around the hole.

U.S. Pat. No. 6,488,175 for "Dusting Mitt Dispensing System" issued to Shiffler et al., on Dec. 3, 2002, describes a dispensing system for dispensing dusting mitts that have a thumb that is folded and arranged to present the thumb at the top of a stack of mitts. The dispensing system includes a carton having a top cover that pivots along a top seam at the back of the carton. The top cover contains a perforation pattern that forms an access flap when the perforations are severed. The access flap is integrally connected to the top cover along a seam to provide access to the contents.

U.S. Pat. No. 6,886,714 for "Container Allowing Choice of Multiple Openings for Dispensing Preference" issued to Kruchoski et al., on May 3, 2005, describes a dispensing container for dispensing sheets in which the container has a first dispensing opening for pop-up dispensing of sheets such as facial tissue. The container has a second opening to provide group dispensing of a plurality of sheets simultaneously without having to disassociate the sheets from each other. The openings can be overlaid on each other, or one opening can be placed on one portion of the container and another opening on another portion of the container to provide a consumer with various dispensing options.

U.S. Patent Application Publication No.: 2007/0210096 A1 for "High-Volume Package Dispense" by Ellswood et al., published on May 3, 2005, describes a dispenser package system for protective articles, having a substantially vertical product storage orientation and package design. The package includes a double or multi-chambered dispenser unit that can provide within substantially the same footprint as a conventional dispenser container a greater volume of product. The package can store and dispense at least 50 percent, up to about 200 percent or greater capacity than conventional dispenser for protective article products such as gloves or face masks.

Thus, the art is continuously seeking new and improved dispensing assemblies for dispensing a variety of products. More specifically, assemblies that effectively dispense individual products, e.g. examination gloves, as the quantity of products become depleted to a level that the products are no longer located near the dispenser opening would be welcomed in the art. The need for such assemblies is particularly apparent for larger volume packages having contents that may settle or become difficult to access, particularly in a health care environment.

BRIEF SUMMARY OF THE INVENTION

Aspects and advantages of the invention will be set forth in part in the following description, or may be obvious from the description, or may be learned through practice of the invention.

In one aspect, the present disclosure is directed to a dispensing assembly for dispensing articles. For example, the articles as described herein may include gloves, facemasks, paper products, dust mitts, or any other articles that would benefit from the dispensing assembly as described herein. The dispensing assembly includes a container having a plurality of exterior panels that define an internal chamber. Further, the exterior panels include at least opposing side panels and a top panel having an opening configured to dispense a plurality of articles therethrough. The dispensing assembly also includes an article dispensing component housed within the internal chamber. The article dispensing component includes a base panel arranged with the top panel of the container so as to form an article storage area. In certain embodiments, the article storage area may have open sides. Further, the article storage area is configured to receive the plurality of articles. Further, the base panel is biased towards the top panel of the container via at least one flexible member that is secured to at least one of the opposing side panels of the container. Thus, the flexible member is configured to allow movement of the base panel toward to the top panel as each article is dispensed from the opening.

In one embodiment, the flexible member(s) may be secured to both of the opposing side panels of the container. In an alternative embodiment, the flexible member(s) may be secured to one of the opposing side panels of the container. In another embodiment, the flexible member(s) may be secured to at least one of the opposing side panels via one or more slots configured in the opposing side panels.

In another embodiment, the base panel may include sharp corners or rounded corners. In further embodiments, the base panel may include one or more notches configured to receive the flexible member. For example, in one embodiment, the base panel may include two pairs of mirrored notches that are configured to receive the flexible member. Further, in certain embodiments, a pair of the mirrored notches may be configured within opposing sides of the base panel (e.g. one notch on one side and one on another side). In alternative embodiments, a pair of the mirrored notches may be configured on the same side of the base panel. In particular embodiments, the mirrored notches may have any suitable cross-sectional shape, including but not limited to at least one of the following cross-sectional shapes: L-shaped, square, triangle, rectangle, or similar.

In further embodiments, each opposing side panel may have a first slot and a second slot. Thus, in such embodiments, the flexible member(s) may be configured to extend through the first and second slots of each side panel and through the mirrored notches of the base panel.

In additional embodiments, the dispensing assembly may also include a tensioning component configured with the flexible member underneath the base panel, e.g. so as to maintain tension in the flexible member.

In yet another embodiment, the base panel may include one or more lines of weakness configured to bend as the base panel is biased towards the top panel of the container.

In still a further embodiment, the plurality of exterior panels of the container may be integral with each other. Thus, in such an embodiment, the panels may be easily folded together to form the container. More specifically, in certain embodiments, one or more of the opposing side panels may be constructed of an outer-most panel, one or more inner-most panels, and an intermediate panel. Further, the outer-most panel may include at least one securement flap configured to fit within a securement slot of the intermediate panel. In addition, the inner-most panels, when arranged together, are configured to define a passageway for the flexible member to pass therethrough when engaged with the base panel. In certain embodiments, the passageway may be adjacent to a bottom panel of the container. Alternatively, the passageway may be adjacent to the top panel of the container.

In additional embodiments, the present disclosure is directed to package of articles. More specifically, the package of articles includes a container according to any of the preceding claims and a plurality of articles disposed within the article storage area of the container, wherein the plurality of articles is biased toward the top panel of the container as articles are dispensed from the opening.

In another aspect, the present disclosure is directed to a method for manufacturing a dispensing assembly. The method includes providing an unfolded container constructed of a plurality of exterior panels that, when folded, define an internal chamber. The exterior panels include, at least, opposing side panels and a top panel having an opening configured to dispense a plurality of articles therethrough. The method also includes securing at least one flexible member to at least one of the opposing side panels of the unfolded container. Further, the method includes securing the flexible member(s) to a base panel so as to define an article storage area. Still another step includes placing a plurality of articles within the article storage area atop the base panel, wherein the base panel is biased towards the top panel of the container via the flexible member(s) so as to allow movement of the base panel toward to the top panel as each article is dispensed from the opening. The method also includes folding the exterior panels of the unfolded container around the article storage area so as to form the dispensing assembly.

In one embodiment, the step of securing the at least one flexible member to at least one of the opposing side panels of the unfolded container may include inserting the flexible member into one or more slots configured in the opposing side panels. Alternatively, in additional embodiments, more than one flexible member may be used. In such an embodiment, the step of securing the at least one flexible member to at least one of the opposing side panels of the unfolded container may include inserting a first flexible member into one or more slots of a first side panel and inserting a second flexible member into one or more slots of a second, opposing side panel.

In another embodiment, the method may also include forming one or more notches in the base panel so as to receive the flexible member. For example, in certain embodiments, the method may include forming opposing mirrored notches in the base panel so as to receive the flexible member. More specifically, in particular embodiments, the method may include forming the mirrored notches within opposing sides of the base panel. Alternatively, the method may include forming the mirrored notches in the same side of the base panel. Thus, the method may also include inserting the flexible member through the first and second slots of each panel and through the mirrored notches of the base panel.

Further, in certain embodiments, the method may include securing a tensioning component to the flexible member underneath the base panel. Thus, the tensioning component is configured to maintain tension of the flexible member as the articles are being dispensed from the container.

In another embodiment, the method may include forming one or more lines of weakness in the base panel such that the base panel is configured to bend as the base panel is biased towards the top panel of the container.

In further embodiments, the method may include constructing the opposing side panels of the container of an outer-most panel, one or more inner-most panels, and an intermediate panel and securing at least one securement flap of the outer-most panel into a securement slot of the intermediate panel when folding the exterior panels of the unfolded container around the article storage area. In additional embodiments, the method may also include arranging the inner-most panels together so as to define a passageway for the flexible member to pass therethrough when engaged with the base panel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
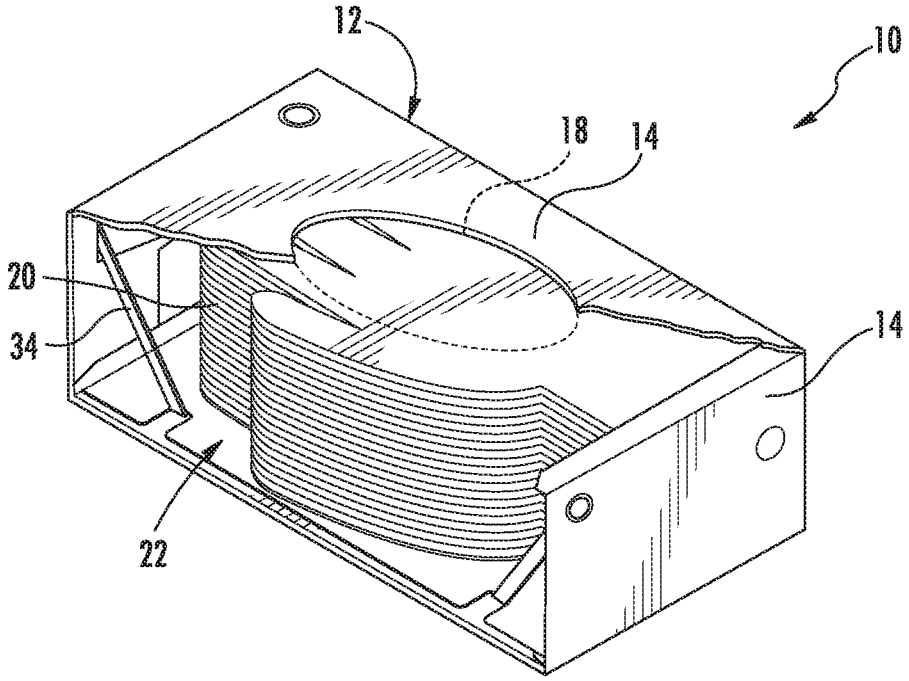
FIG. 1 illustrates a perspective view of one embodiment of a dispensing assembly for dispensing articles according to the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Dispensing disposable examination gloves from a package can be particularly difficult. For smaller-sized examination gloves, such as, for example, standard small or extra-small sizes, users may wish to have a smaller orifice to access the contents of the carton to prevent gloves from spilling out. The size of these gloves may be close to or not much larger than the size of the orifice. In some cases, the dimensions of the gloves may be smaller than the size of the orifice. This is particularly notable when the dispensing carton is initially opened and the contents are immediately adjacent the orifice. However, for larger-sized examination gloves, such as, for example, standard large or extra-large sizes, users may wish to have a larger orifice to provide for easier dispensing from the carton. The size of these gloves may be larger or even much larger than a typical glove dispensing orifice.

In order to improve economy, dispensing assemblies or packages are frequently larger in size to hold larger quantities of articles. When dispensing articles such as, for example, disposable examination gloves from a larger carton or package, dispensing becomes problematic after a sufficient quantity of articles (e.g., gloves) is depleted since the gloves are no longer readily accessible near the dispensing opening. Users are forced to tip the dispensing assembly or package or even insert their fingers or entire hand deep into the package to grasp and withdraw an article. The opening is typically about the same size as the user's hand, so mobility as well as vision inside the package (e.g., the chamber of the dispensing assembly) is restricted.

Thus, the present invention is directed to an improved dispensing assembly that allows the gloves of the assembly to be pushed closer to the opening to enhance access to the interior of the container. This is particularly important for larger volume packages having contents that may settle or become difficult to access, especially in a health care environment.

For example, the present invention allows the user to remove a certain number of articles with each subsequent article being just as readily available as the previous article. More specifically, as the contents settle or a sufficient quantity of articles (e.g., gloves) is depleted such that the gloves are no longer readily accessible near the orifice, the present invention allows the base panel of the article dispensing component to be biased towards the top panel of the container such that the articles remain close to the dispensing opening. Thus, the dispensing assembly of the present disclosure is suitable for use with large containers.

Figure 2:
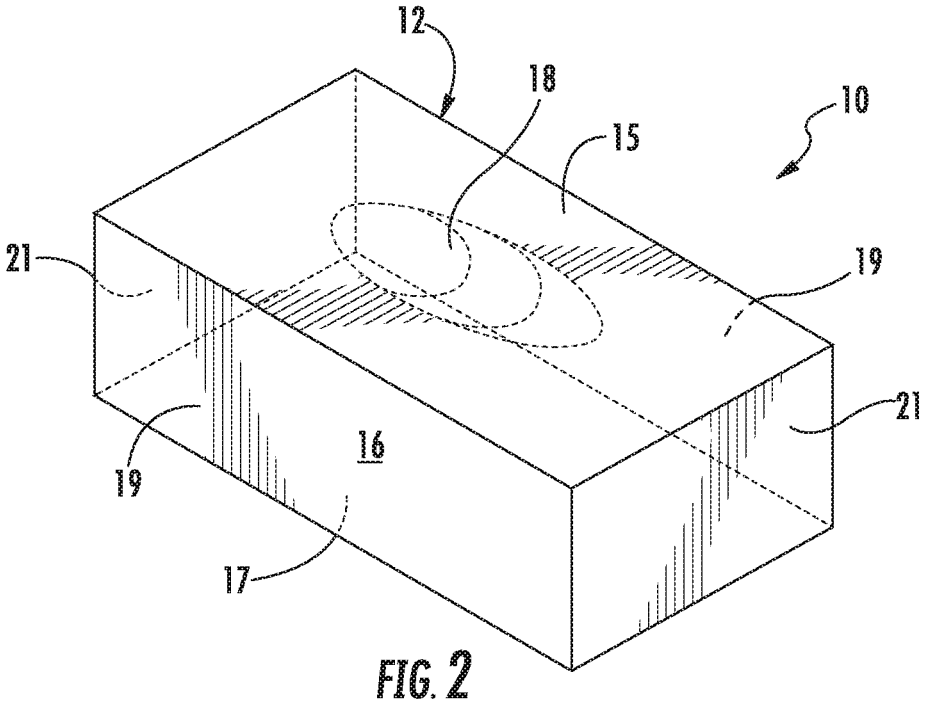
FIG. 2 illustrates a perspective view of one embodiment of a container of a dispensing assembly according to the present disclosure.

Referring now to the drawings, FIG. 1 illustrates a perspective, cut-away view of an exemplary dispensing assembly 10 or package for dispensing articles such as, for example, disposable examination gloves, facemasks, paper products (e.g. tissues, paper towels, etc.) dust mitts, or the like. As shown in FIGS. 1 and 2, the dispensing assembly 10 includes a container 12 having a plurality of exterior panels 14. The exterior panels 14 may be constructed of any suitable material such as, for example, carton cardboard stock, paperboard, heavy structural paper, container stock, corrugated paperboard, plastic coated paper, plastic sheets, wax-coated papers or the like, and combinations thereof. Further, as shown in FIG. 2, the exterior panels 14 of the container 12 are configured to define an internal chamber 16, e.g. when folded.

More specifically, as shown in FIGS. 2, 6, 10, and 18, the exterior panels 14 include a top panel 15, a bottom panel 17, and a plurality of side panels. More specifically, as shown, the exterior panels include a first set of opposing side panels 19 and a second set of opposing side panels 21. As used herein, any of the side panels 19, 21 may be configured to open, thereby allowing insertion or removal of a plurality of articles as described herein. In addition, it should be understood that the term "side panels" may generally refer to any of the sides of the container 12, including for example, side panels and/or end panels. For example, where the container 12 has a square configuration, the side panels may all have the same configuration.

Figure 3:
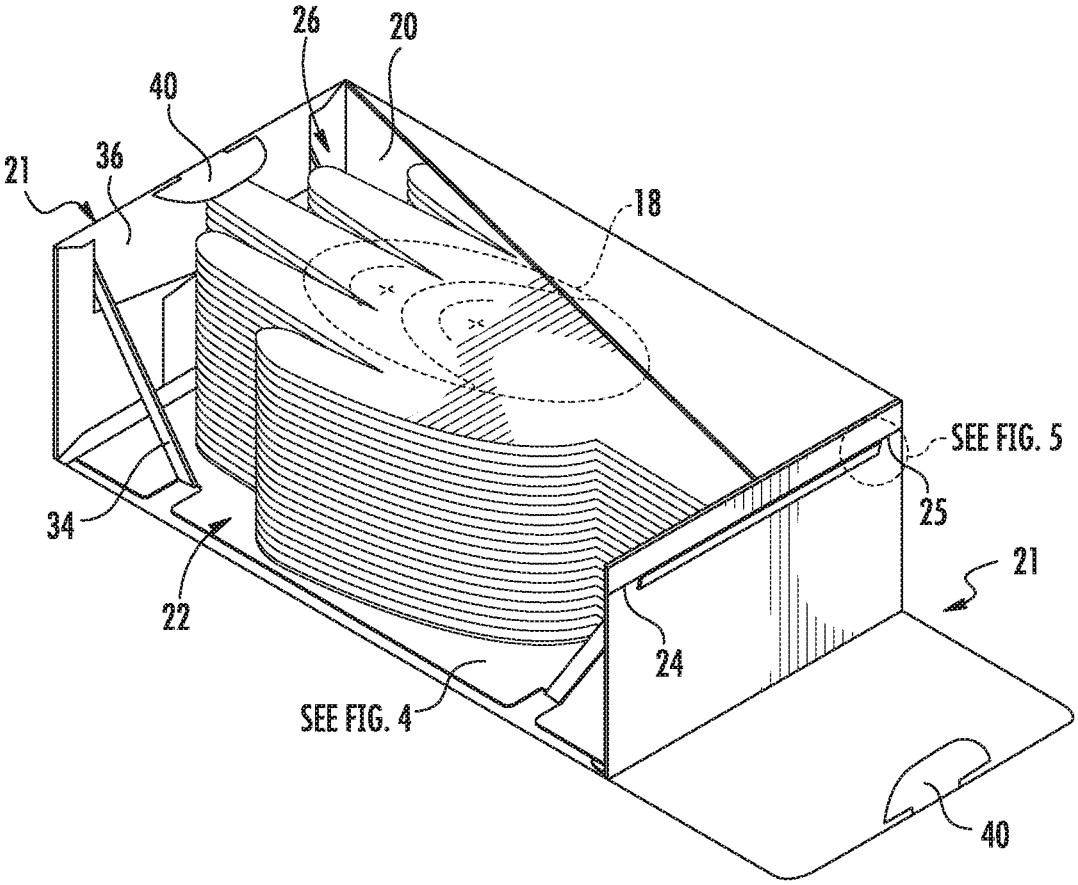
FIG. 3 illustrates a perspective view of one embodiment of a dispensing assembly according to the present disclosure, particularly illustrating a cut-away view of the dispensing assembly to further illustrate various internal components thereof.
Figure 6:
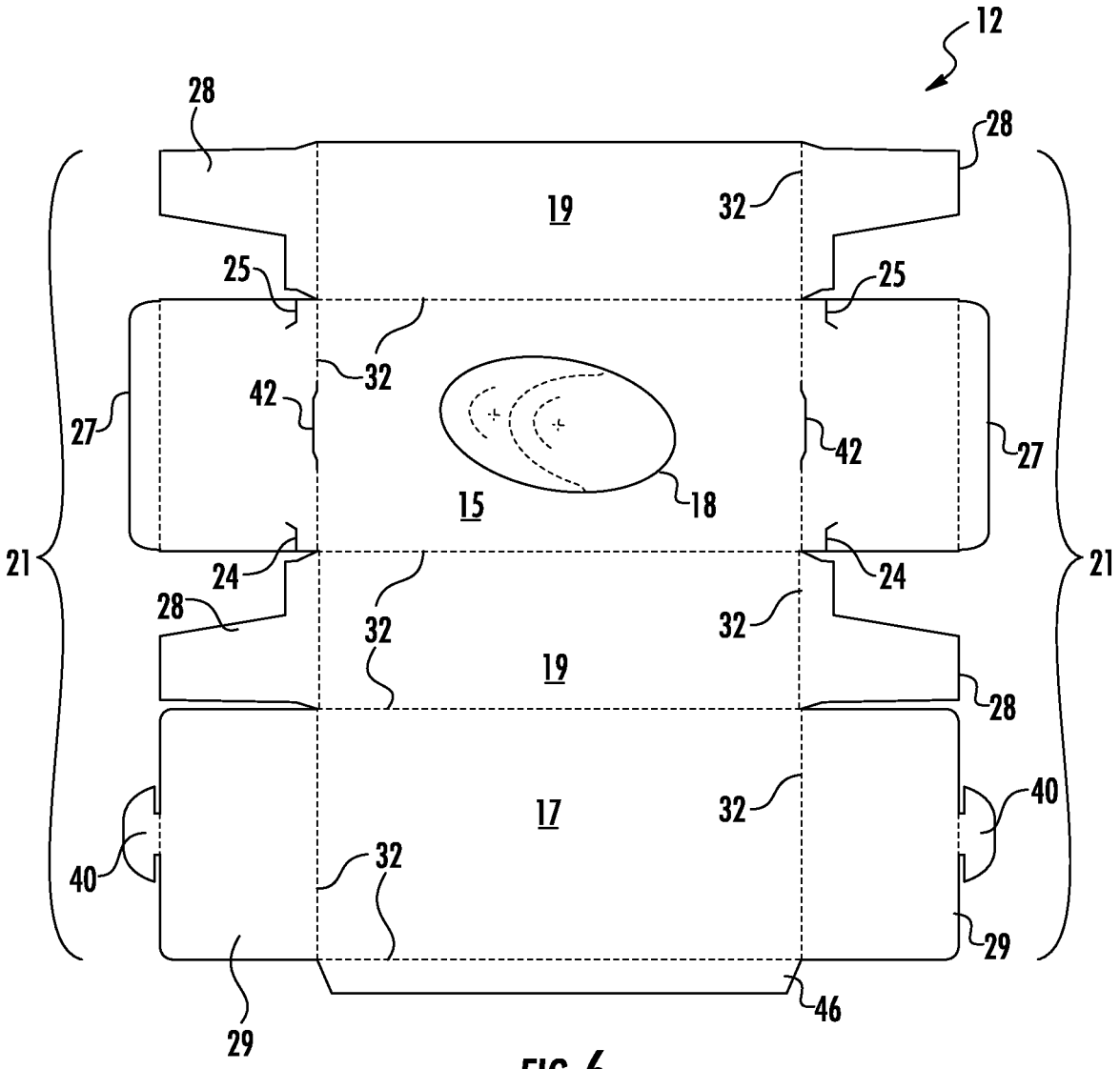
FIG. 6 illustrates a top view of one embodiment of an unfolded container of a dispensing assembly according to the present disclosure.
Figure 8:
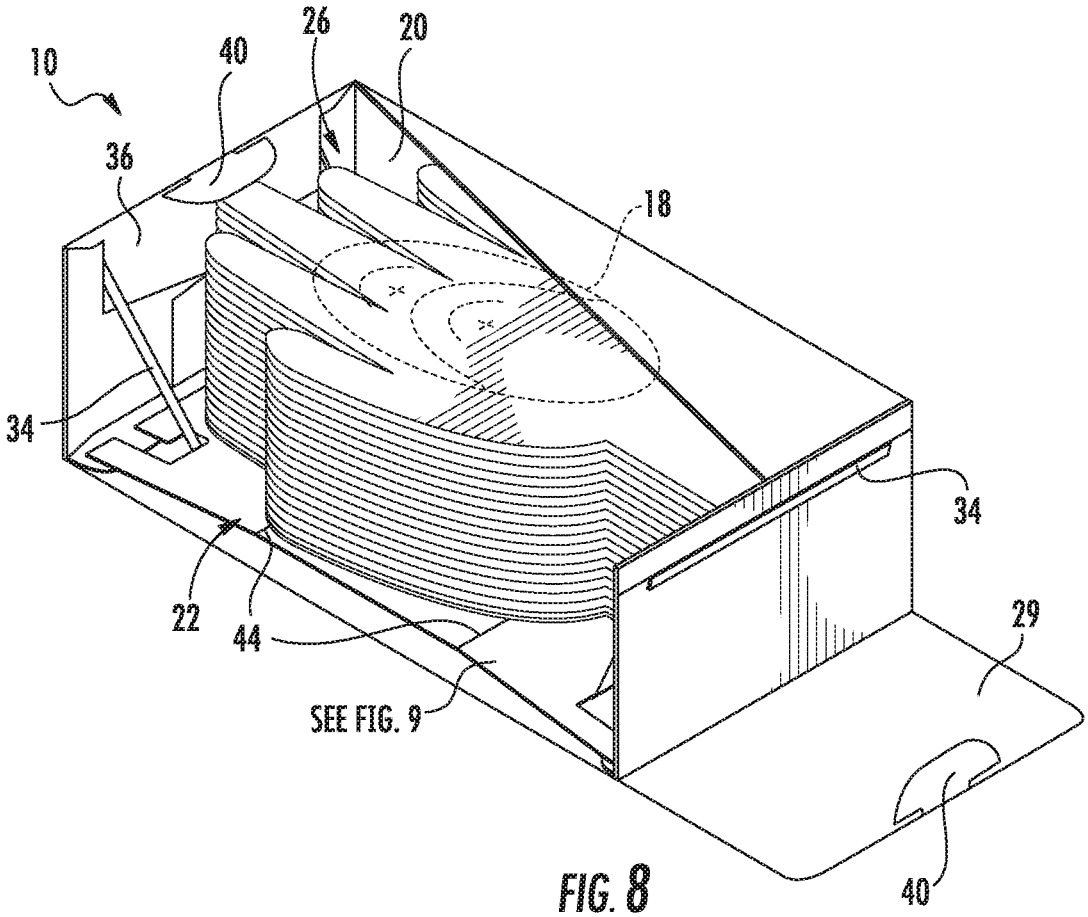
FIG. 8 illustrates a perspective view of another embodiment of a dispensing assembly according to the present disclosure, particularly illustrating a cut-away view of the dispensing assembly to further illustrate various internal components thereof.
Figure 9:
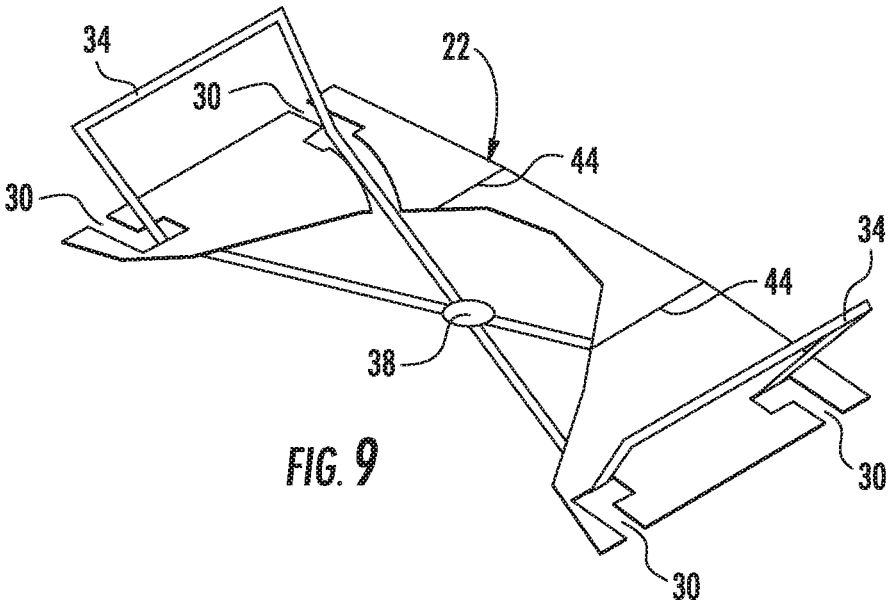
FIG. 9 illustrates a perspective view of the base panel of the dispensing assembly of FIG. 8.
Figure 10:
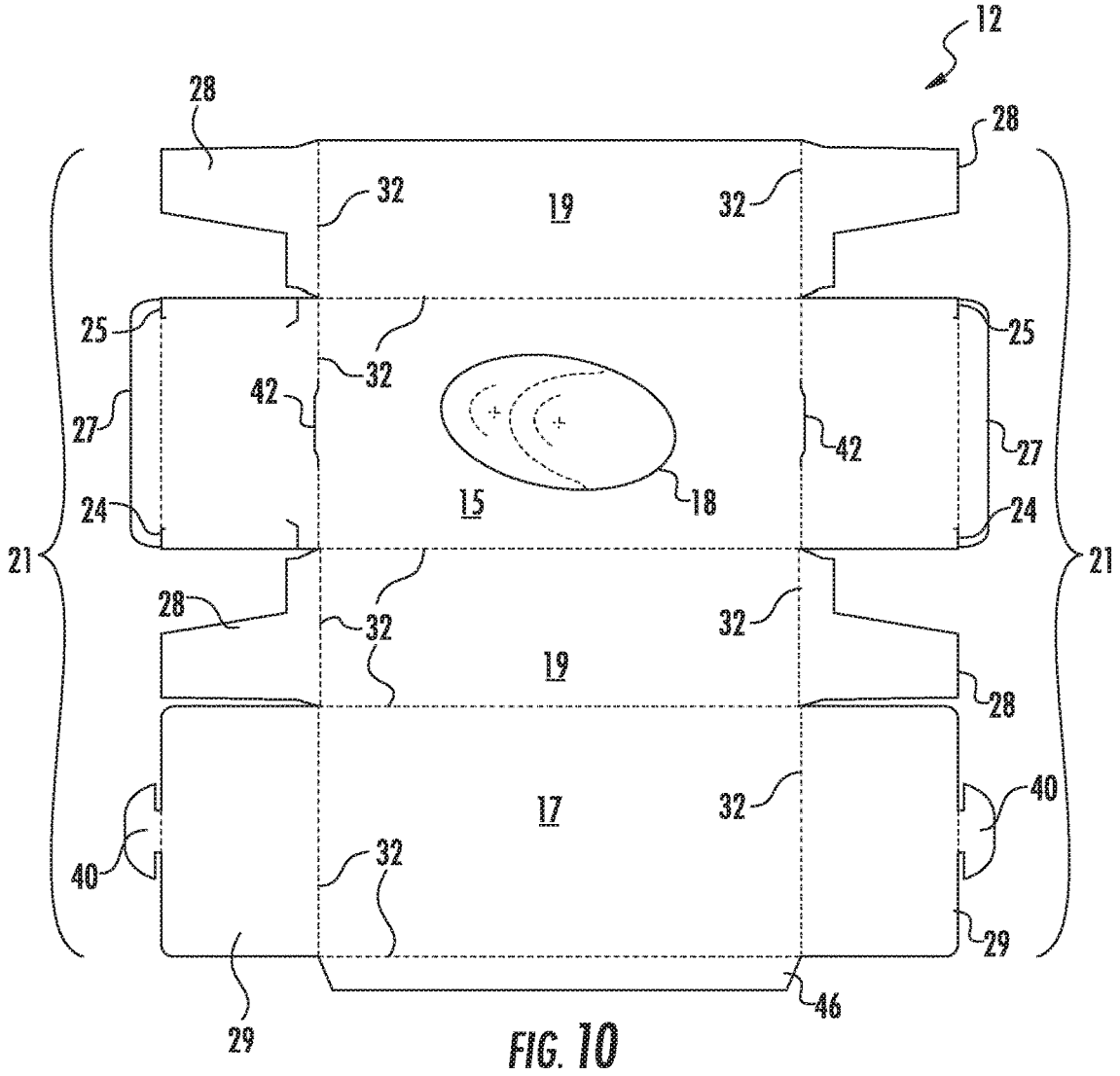
FIG. 10 illustrates a top view of another embodiment of an unfolded container of a dispensing assembly according to the present disclosure.
Figure 13:
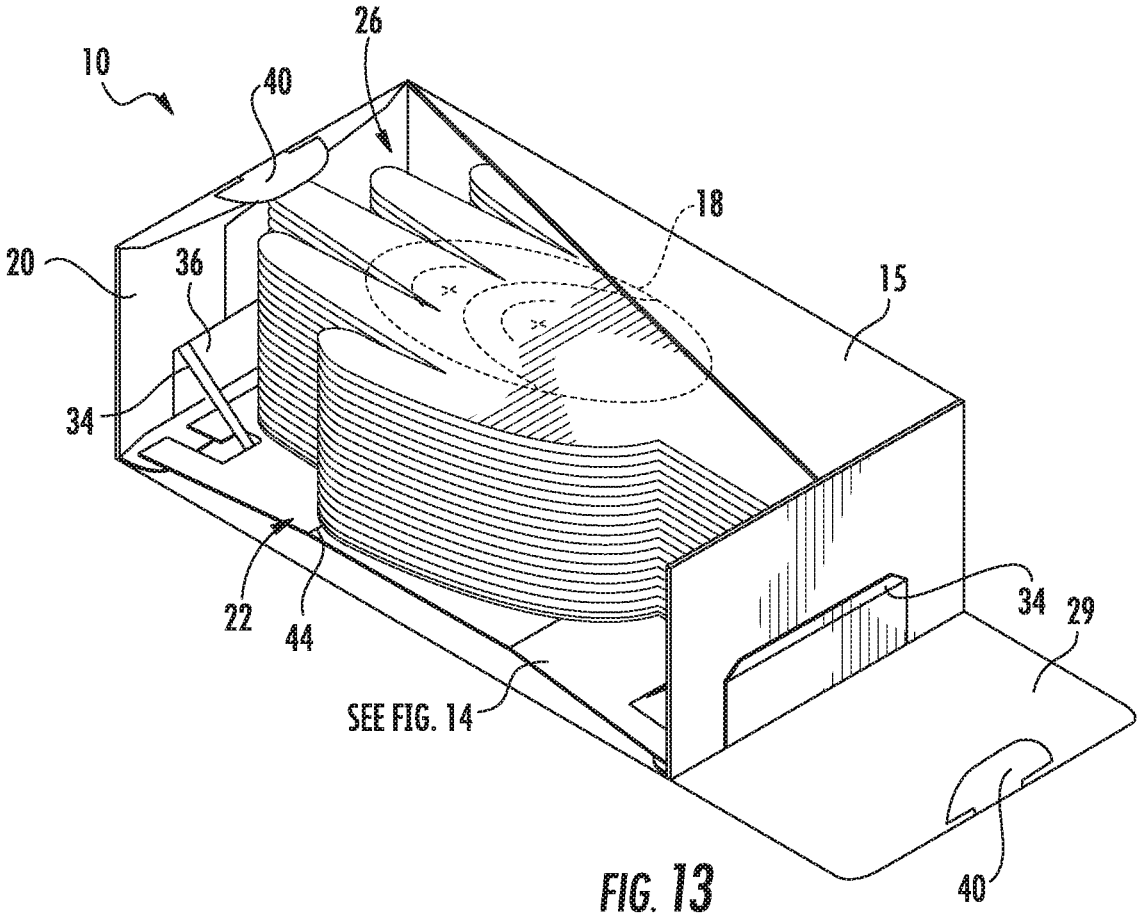
FIG. 13 illustrates a perspective view of yet another embodiment of a dispensing assembly according to the present disclosure, particularly illustrating a cut-away view of the dispensing assembly to further illustrate various internal components thereof.
Figure 14:
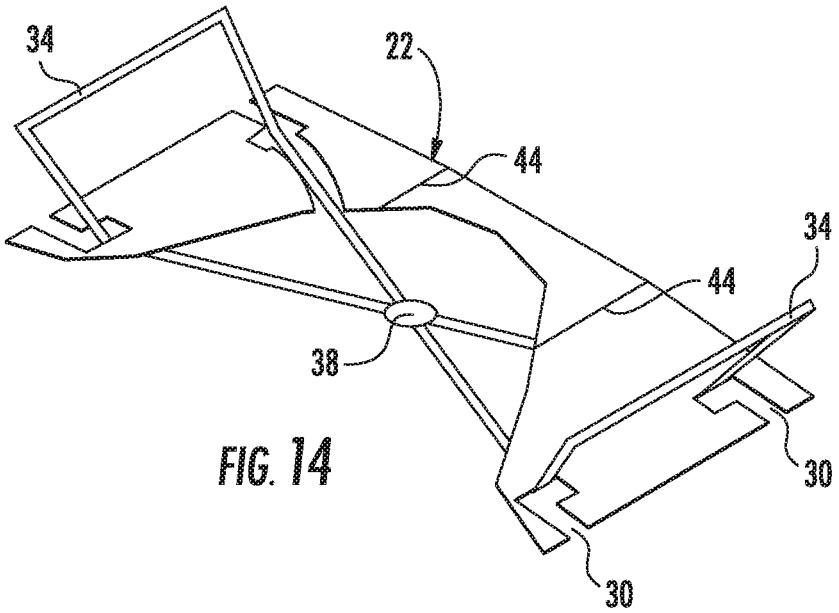
FIG. 14 illustrates a perspective view of the base panel of the dispensing assembly of FIG. 12.
Figure 15:
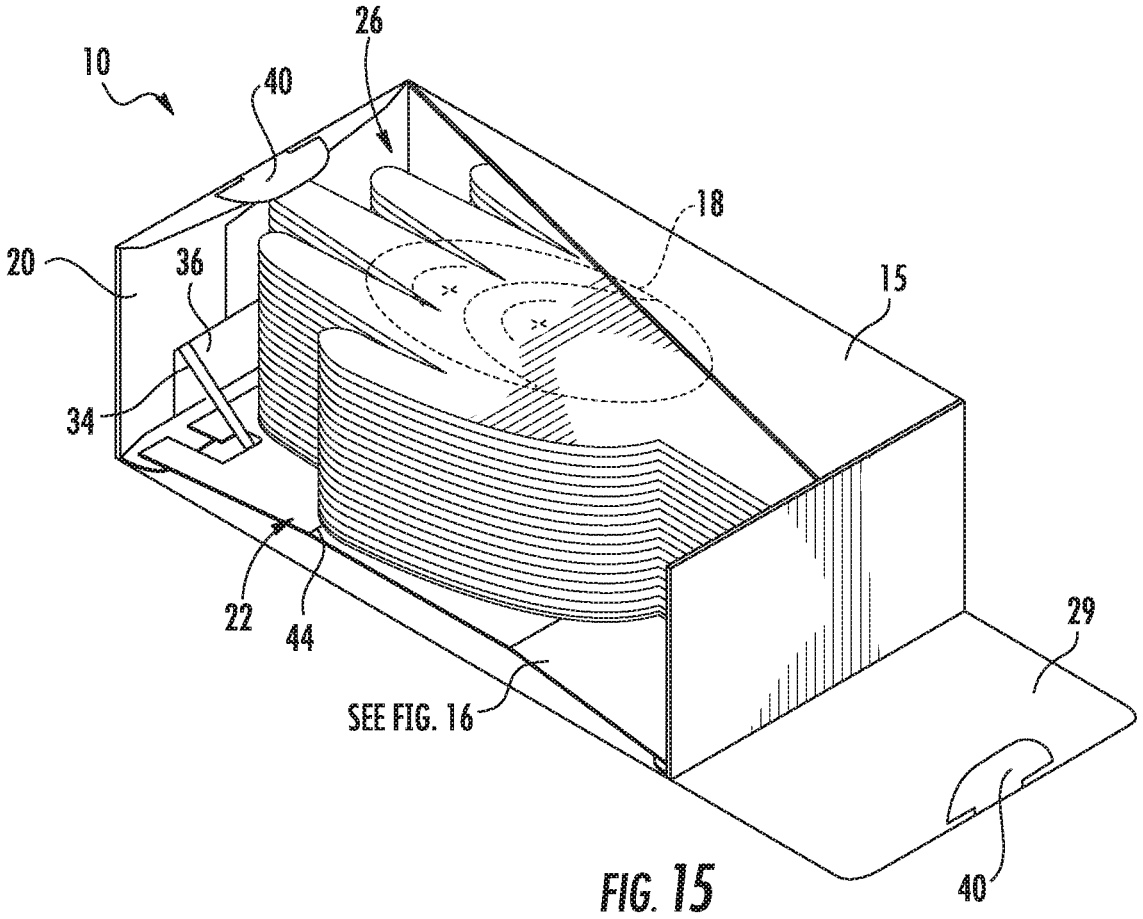
FIG. 15 illustrates a perspective view of yet another embodiment of a dispensing assembly according to the present disclosure, particularly illustrating a cut-away view of the dispensing assembly to further illustrate various internal components thereof.
Figure 18:
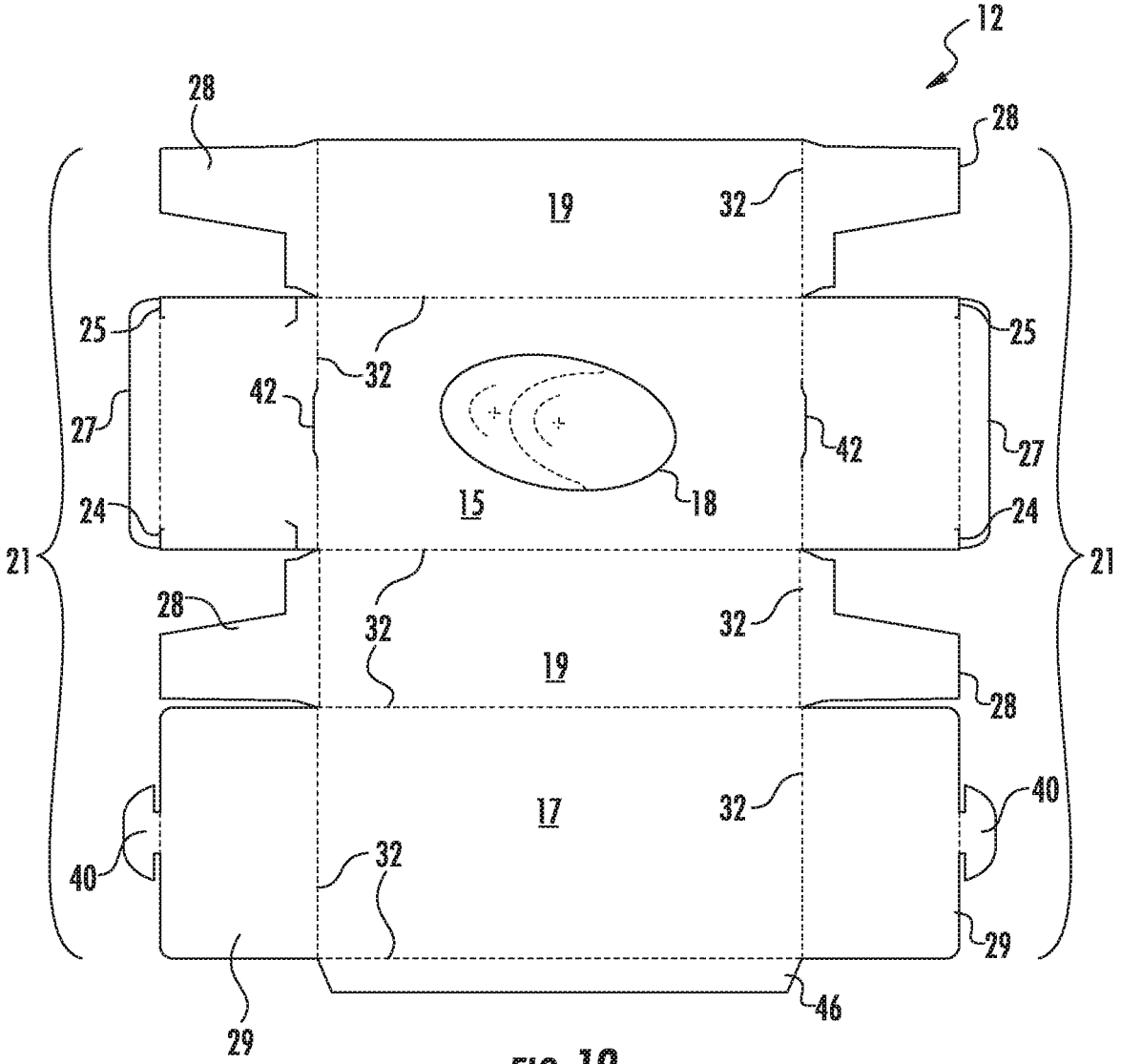
FIG. 18 illustrates a top view of yet another embodiment of an unfolded container of a dispensing assembly according to the present disclosure.

In addition, the exterior panels 14 may be integral with each other, e.g. as shown in FIGS. 3, 6, 8, 10, 13, and 15. Thus, as shown particularly in FIGS. 6, 10, and 18, the exterior panels 14 may be constructed of a unitary piece of material divided into multiple parts via one or more seams 32 that can be easily folded along each seam 32 to form the container 12. More specifically, as shown in FIGS. 3, 6, 8, 10, 13, and 18, opposing side panels (e.g. the opposing end panels 21 may include a multi-paneled configuration. For example, as shown in FIGS. 6, 10 and 18, each opposing side panel 21 may include one or more inner-most panels 28, an intermediate panel 27, and an outer-most panel 29. Further, as shown, the outer-most panel 29 may include at least one securement flap 40 configured to fit within a securement slot 27 of an adjacent panel, e.g. the intermediate panel 27. In addition, as shown, the inner-most panels 28, when arranged together as shown in FIGS. 3, 8, and 13, are configured to define a passageway 36 for the flexible member(s) 34 to pass therethrough when engaged with the base panel 22. In certain embodiments, as shown in FIGS. 13 and 15, the passageway 36 may be adjacent to the bottom panel 17 of the container 12. Alternatively, as shown in FIGS. 3 and 8, the passageway 36 may be adjacent to the top panel 15 of the container 12.

More specifically, as shown in FIGS. 6, 10, and 18, at least one of the exterior panels 14 (e.g. the outer-most panels 29) of the container 12 may include one or more securement flaps 40 configured to fit within one or more securement slots 42 of adjacent exterior panels 14 (e.g. the intermediate panel 27). Thus, when the exterior panels 14 are folded, the panels can be easily secured together, e.g. by inserting the securement flaps 40 into the securement slots 42. In addition, the securement flaps 40 and the securement slots 42 allow for easy opening of the container 12, e.g. such that the articles can be inserted within the internal chamber 16. Alternatively, the exterior panels 14 may be separate and detached pieces of material e.g. that may be joined together via any suitable means, including but not limited to adhesive, tape, clamps, or similar. In further embodiments, certain panels of the container 12 may be excluded, for example, the bottom panel 17, or any other suitable combination.

Further, as shown generally in the figures, the top panel 15 includes an opening 18 configured to dispense a plurality of articles therethrough. In addition, as shown, the opening 18 has a generally oval shape, however, it should be understood that the opening 18 may have any other suitable shape such that one or more articles can be dispensed therethrough. Further, as shown, the opening 18 may include a removable section defined by perforations, scores, underscores, or partial cuts through the material and combinations thereof. Such features are known to those of ordinary skill in the art. For example, U.S. Pat. No. 4,158,412 for "Tear Out Opening Device" issued to Wysocki on Jun. 19, 1979, describes half-cut configurations used for a tear out flap, the contents of which are incorporated herein by reference in its entirety. In addition, the opening 18 may be configured according to U.S. Pat. No. 8,646,653 entitled "Dispensing Assembly and Package of Articles" which is incorporated herein by reference in its entirety.

Referring particularly to FIGS. 1, 3, 8, and 13, the dispensing assembly 10 also includes an article dispensing component 20 housed within the internal chamber 16. More specifically, as shown, the article dispensing component 20 includes a base panel 22 arranged with the top panel 15 of the container 12 so as to form an article storage area 26. Thus, the article storage area 26 is configured to receive the plurality of articles therein. In certain embodiments, as shown, the article storage area 26 may have open sides. Alternatively, the article storage area 26 may have closed sides. In addition, as shown in the illustrated embodiment, the base panel 22 is configured to form the bottom of the article storage area 26 and the top panel 15 of the container 12 is configured to form the top of the article storage area 26.

Further, as shown in the illustrated embodiment, the base panel 22 is biased towards the top panel 15 of the container 12 via at least one flexible member 34 that is secured to opposing side panels (e.g. opposing end panels 21). More specifically, as generally shown in the figures, the top panel 15, by design, is stationary, whereas the base panel 22 may be biased towards the top panel 15 via the flexible member 34. In other words, the base panel 22 may be configured to move relative to the top panel 15 as each article (e.g. glove) is dispensed from the opening 18 of the container 12. In addition, as shown in FIGS. 8, 9, and 11-14, the base panel 22 may also include one or more lines of weakness 44 configured to bend as the base panel 44 is biased towards the top panel 15 of the container 12. Thus, the lines of weakness 44 provide flexibility to the base panel 22 as it is biased towards the top panel 15.

Figure 4:
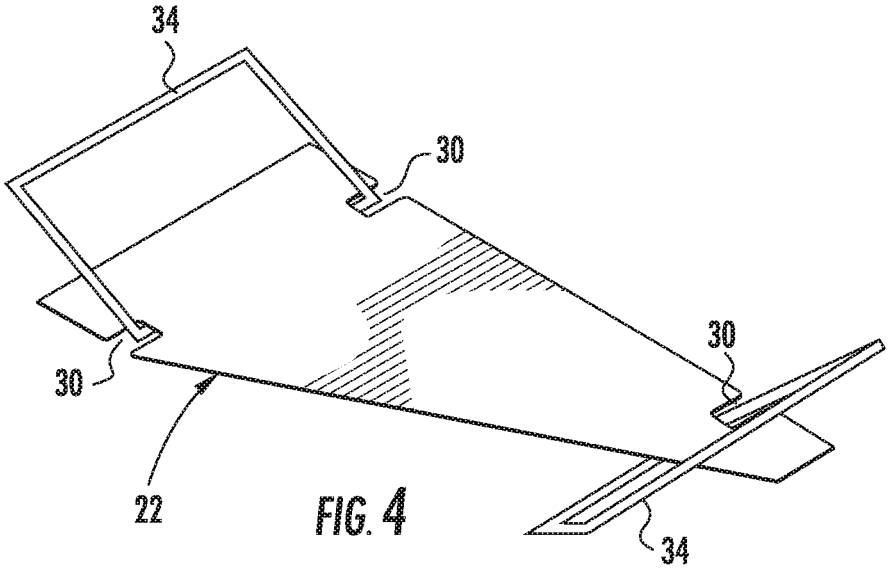
FIG. 4 illustrates a perspective view of the base panel of the dispensing assembly of FIG. 3.
Figure 5:
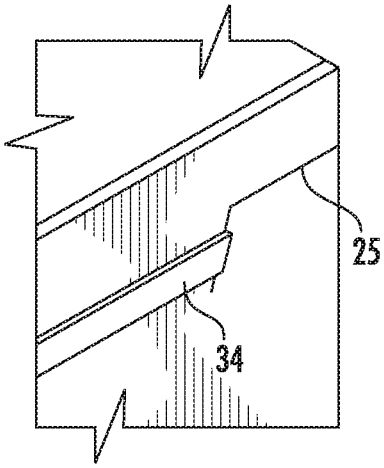
FIG. 5 illustrates a detailed view of the intermediate panel of the dispensing assembly of FIG. 3, particularly illustrating a flexible member configured within a slot of the intermediate panel.

It should be understood that the flexible members 34 as described herein may include any suitable members configured to bias the base panel 22 towards the top panel 15 of the container 12, e.g. elastic or rubber bands, springs, etc. More specifically, as shown, the flexible members 34 may be elastic bands. Accordingly, the flexible members 34 are configured to allow movement of the base panel 22 toward to the top panel 15 as each article is dispensed from the opening 18. In addition, any number of flexible members 34 may be used in the dispensing assembly 10. For example, as shown in FIGS. 3 and 4, the article dispensing component 20 may include two flexible members 34. In additional embodiments, the article dispensing component 20 may include more than two flexible members 34. Alternatively, as shown in FIGS. 8, 9, 13, and 14, the article dispensing component 20 may include a single flexible member 34. In addition, in such embodiments, the dispensing assembly 10 may also include a tensioning component 38 configured with the flexible member 34, e.g. underneath the base panel 22, so as to maintain tension in the flexible member 34 as articles are dispensed from the opening 18. The tensioning component 38 may be any suitable structure configured to provide a suitable tension to the flexible member 34, including e.g. a clamp, pin, hook, adhesive, tape, or similar.

Figure 16:
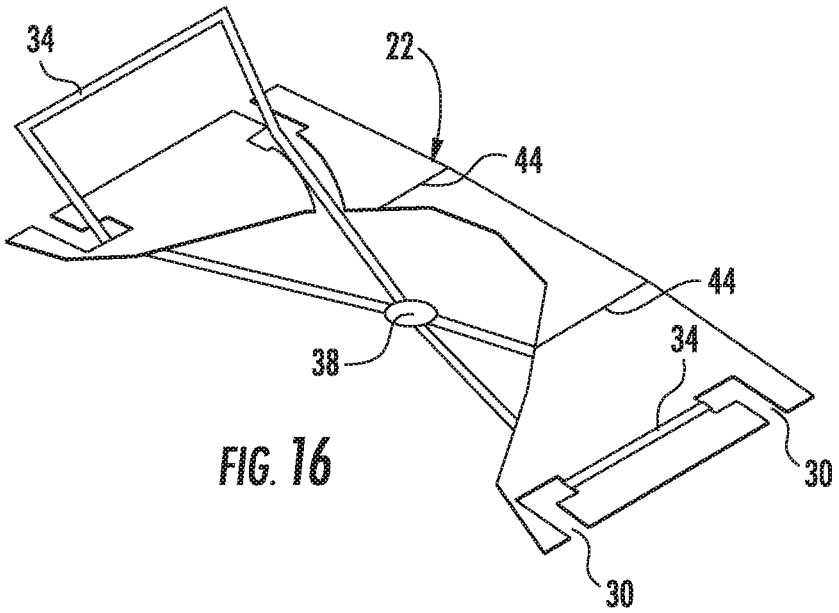
FIG. 16 illustrates a perspective view of the base panel of the dispensing assembly of FIG. 15, particularly illustrating the base panel in an unbiased position.
Figure 17:
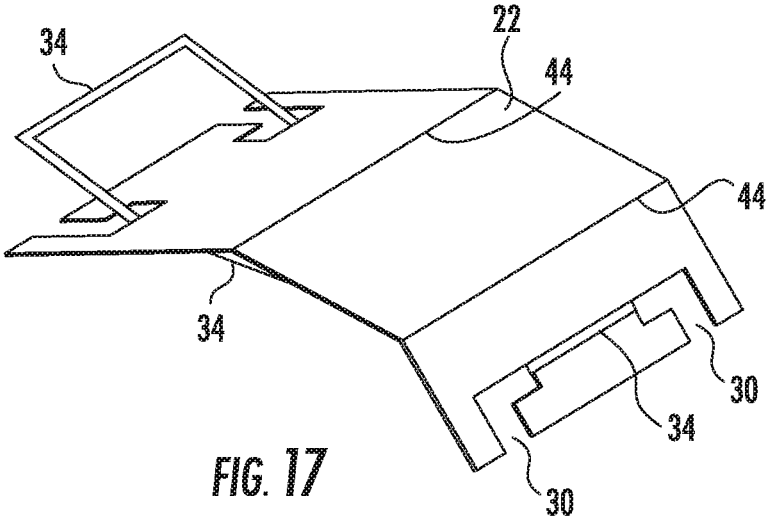
FIG. 17 illustrates a perspective view of the base panel of the dispensing assembly of FIG. 15, particularly illustrating the base panel in a biased position.

In further embodiments, the flexible member(s) 34 may be secured to one or more of the opposing side panels 19, 21 of the container 12 using any suitable means. More specifically, as shown generally in FIGS. 1-14, the flexible member(s) 34 may be secured to both of the opposing side panels 19, 21 of the container 12. In an alternative embodiment, as shown in FIGS. 15-17, the flexible member(s) 34 may be secured to one of the opposing side panels 19, 21 of the container 12, e.g. rather than both. Thus, as shown particularly in FIGS. 16-17, the flexible member 34 is configured to bias at least a middle portion of the base panel 22 towards the opening 18 as articles are dispensed therefrom.

In additional embodiments, as shown, the flexible member(s) 34 may be secured to one or more of the opposing side panels 19, 21 via one or more slots 24, 25 configured in the opposing side panels 19, 21. For example, as shown in FIGS. 3 and 6, each opposing side panel 21 may have a first slot 24 and a second slot 25. Thus, in such embodiments, a first flexible member 34 may be secured to the side panel 21 by being inserted into the first and second slots 24 of the side panel 21 and a second flexible member 34 may be secured to an opposing side panel 21 by being inserted into the first and second slots 24 of the opposing side panel 21. Further, as shown, the flexible members 34 are configured to extend through the first and second slots 24, 25 of each panel 21 and to the base panel 22. In alternative embodiments, the flexible member(s) 34 may be secured to the side panels of the container 12 using adhesive, tape, clamps, or similar.

Figure 7:
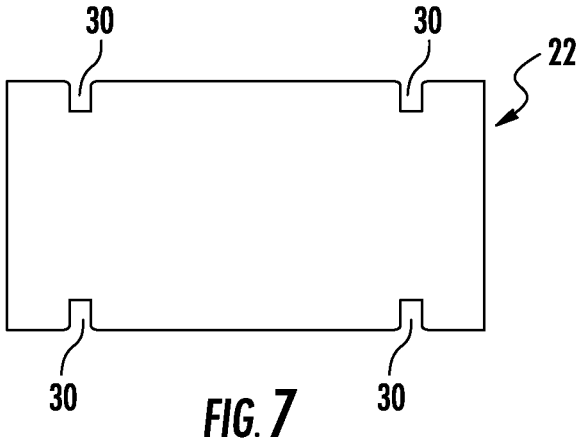
FIG. 7 illustrates a top view of one embodiment of a base panel of a dispensing assembly according to the present disclosure.
Figure 11:
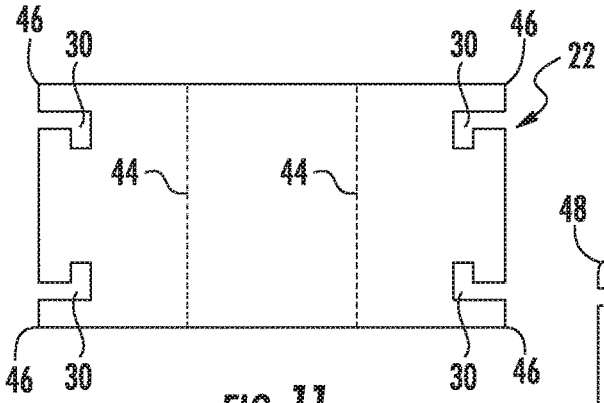
FIG. 11 illustrates a top view of another embodiment of a base panel of a dispensing assembly according to the present disclosure, particularly illustrating a base panel having sharp corners.
Figure 12:
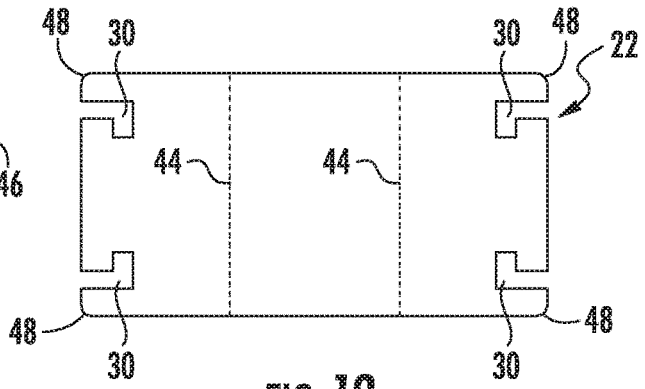
FIG. 12 illustrates a top view of yet another embodiment of a base panel of a dispensing assembly according to the present disclosure, particularly illustrating a base panel having rounded corners.

In additional embodiments, as shown in FIG. 11, the base panel 22 may include one or more corners 46 configured to abut against an internal wall of the container 12. Thus, in such embodiments, the corners 46 are configured to move along the internal wall of the container 12 as the base panel 22 is biased towards the top panel 15 of the container 12. In alternative embodiments, as shown in FIG. 12, the base panel 22 may have rounded corners 48. Thus, in such embodiments, the rounded corners 48 are configured to reduce pinching of the articles as the base panel 22 moves towards to the top panel 15, thereby reducing the articles from becoming stuck.

may include one or more notches 30 configured to receive one of the flexible members 34. For example, as shown in FIGS. 4, 7, 9, 11-14, the base panel 22 may include at least two pairs of mirrored notches 30 configured to receive the flexible member(s) 34 such that the flexible member(s) 34 bias the base panel 22 towards the opening 18 of the top panel 15. More specifically, as shown, in FIGS. 3, 4, and 7, a pair of mirrored notches 30 may be configured within opposing sides of the base panel 22. In alternative embodiments, as shown in FIGS. 8, 9, and 11-14, a pair of mirrored notches 30 may be configured in the same side of the base panel 22. In addition, the mirrored notches 30 may have any suitable cross-sectional shape, including but not limited to at least one of the following cross-sectional shapes: L-shaped, square, triangle, rectangle, or similar. For example, as shown in FIGS. 3, 4, and 7, the notches 30 have a generally rectangular shape. Alternatively, as shown in FIGS. 8, 9, and 11-14, the notches 30 have an L-shaped configuration. In additional embodiments, the flexible member(s) 34 may be secured to the base panel 22 using any other suitable means, for example, via adhesive, tape, clamps, or similar.

Further, the first and second slots 24, 25 and/or the mirrored notches 30 in the base panel 22 may be configured or adjusted (e.g., moved closer together or made deeper, etc.) so as to reduce the tension provided by the flexible member(s) 34. By reducing the tension in the flexible member(s) 34, the dispensing assembly 10 can be more easily manufactured and assembled. In addition, the inventors of the present disclosure have discovered that the flexible member(s) 34 does not have to provide tension to urge a full load of articles (e.g. gloves) towards the dispensing opening 18, but only needs to provide sufficient tension to urge less than a full load of articles towards the opening 18. Further, the required tension steadily decreases as the articles are dispensed from the opening 18. Alternatively and/or additionally, the initial size/dimensions of the flexible member(s) 34 and/or the material of the flexible member(s) 34 may be altered to reduce the tension in the flexible member(s) 34.

Figure 19:
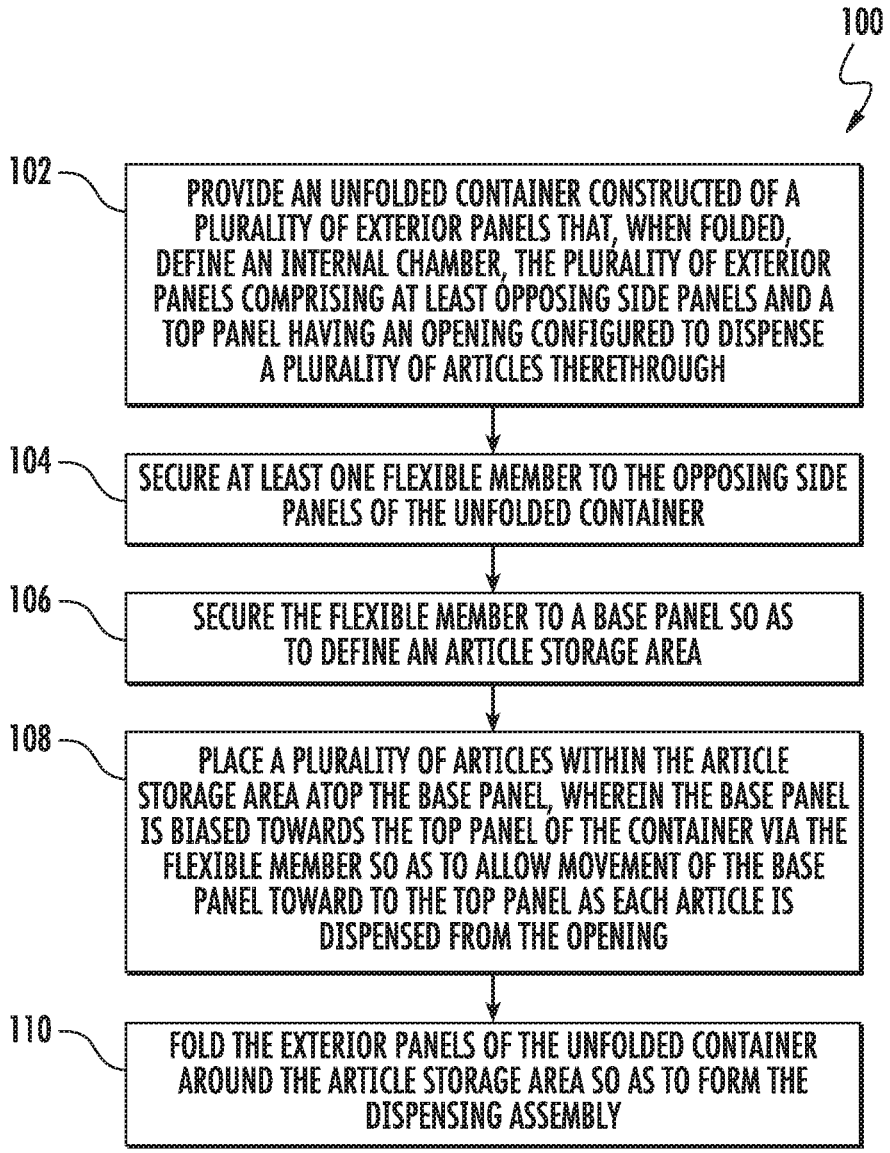
FIG. 19 illustrates a flow diagram of one embodiment of a method of manufacturing a dispensing assembly according to the present disclosure.

Referring now to FIG. 19, a flow diagram of one embodiment of a method 100 for manufacturing a dispensing assembly 10 for dispensing articles such as gloves, facemasks, paper products, dust mitts, or the like according to the present disclosure is illustrated. As shown at 102, the method 100 includes providing an unfolded container 12 constructed of a plurality of exterior panels 14 that, when folded, define an internal chamber 16. As mentioned, the exterior panels 14 include, at least, opposing side panels (e.g. panels 19 or 21) and a top panel 15 having an opening 18 configured to dispense a plurality of articles therethrough. As shown at 104, the method 100 also includes securing at least one flexible member 34 to at least one of the opposing side panels (e.g. panels 19 or 21) of the unfolded container 12. As shown at 106, the method 100 includes securing the flexible member 34 to a base panel 22 so as to define an article storage area 26. As shown at 108, the method 100 includes placing a plurality of articles within the article storage area 26 atop the base panel 22, wherein the base panel 22 is biased towards the top panel 15 of the container 12 via the flexible member 34 so as to allow movement of the base panel 22 toward to the top panel 15 as each article is dispensed from the opening 18. As shown at 110, the method 100 includes folding the exterior panels 14 of the unfolded container 12 around the article storage area 26 so as to form the dispensing assembly 10.

In one embodiment, the step of securing at least one flexible member 34 to at least one of the opposing side panels (e.g. side panels 21) of the unfolded container 12 may include inserting the flexible member 34 into one or more slots (e.g. first and second slots 24, 25) configured in the opposing side panels 21.

In another embodiment, the method 100 may also include forming one or more notches 30 in the base panel 22 so as to receive the flexible member 34. For example, in certain embodiments, the method 100 may include forming at least two pairs of opposing mirrored notches 30 in the base panel 22 so as to receive the flexible member(s) 34. More specifically, in particular embodiments, the method 100 may include forming the pairs of mirrored notches 30 within opposing sides of the base panel 22 (FIG. 7). Alternatively, the method 100 may include forming the pairs of mirrored notches 30 in the same side of the base panel 22 (FIG. 11).

In additional embodiments, the method 100 may include forming a first slot 24 and second slot 25 in each of the opposing side panels 21 and inserting the flexible member 34 through the first and second slots 24, 25 of each panel 21 and through the mirrored notches 30 of the base panel 22. Further, the method 100 may include securing a tensioning component 38 to the flexible member 34, e.g. underneath the base panel 22. Thus, the tensioning component 38 is configured to maintain tension of the flexible member 34 as the articles are being dispensed from the container 12.

In another embodiment, the method 100 may include forming one or more lines of weakness 44 in the base panel 22 such that the base panel 22 is configured to bend as the base panel 22 is biased towards the top panel 15 of the container 12.

In further embodiments, the method 100 may also include constructing the opposing side panels (e.g. panels 19 and 21) of the container 12 of an outer-most panel 29, one or more inner-most panels 28, and an intermediate panel 27 (FIGS. 6, 10, and 18) and securing at least one securement flap 40 of the outer-most panel 29 into a securement slot 42 of the intermediate panel 27 when folding the exterior panels 14 of the unfolded container 12 around the article storage area 26. In additional embodiments, the method 100 may also include arranging the inner-most panels 28 together so as to define a passageway 36 for the flexible member(s) 34 to pass therethrough when engaged with the opposing side panels and the base panel 22.

The plurality of articles as described herein is desirably a plurality of disposable articles. As used herein, the term "disposable" refers to a product that is so inexpensive that it may economically be discarded after only a single use. Products that are "disposable" are typically intended for single use. The term "single-use" refers to a product that is intended to be used only once and is not intended to be re-used, re-conditioned, restored or repaired after that use. Such products offer advantages in clinical settings by reducing the potential for contamination or infection. In addition, these products can enhance work flow since they are not collected and assembled for reprocessing and reuse. Examples of disposable articles include disposable examination gloves, disposable facemasks and the like.

While various patents have been incorporated herein by reference, to the extent there is any inconsistency between incorporated material and that of the written specification, the written specification shall control. In addition, while the disclosure has been described in detail with respect to specific embodiments thereof, it will be apparent to those skilled in the art that various alterations, modifications and other changes may be made to the disclosure without departing from the spirit and scope of the present disclosure. It is therefore intended that the claims cover all such modifications, alterations and other changes encompassed by the appended claims.

What is claimed is:

1. A dispensing assembly, comprising:

a container comprising a plurality of exterior panels defining an internal chamber, the plurality of exterior panels comprising at least opposing side panels and a top panel having an opening configured to dispense a plurality of articles therethrough, the opposing side panels each constructed of an outer-most panel, a plurality of inner-most panels each comprising a cut-out, and an intermediate panel, wherein the plurality of inner-most panels, when arranged together in a closed position, overlap each other such that the cut-outs of the plurality of inner-most panels define a passageway extending from a top edge of the plurality of inner-most panels, the passageway comprising a height that is less than a height of the container; and an article dispensing component housed within the internal chamber, the article dispensing component comprising a base panel arranged with the top panel of the container to form an article storage area, the article storage area configured to receive the plurality of articles, wherein the base panel is biased towards the top panel of the container via a flexible member that passes through one or more notches of the base panel and the passageway formed by the cut-outs of the plurality of inner-most panels of the opposing side panels.

2. The dispensing assembly of claim 1, wherein the flexible member is secured through the passageway formed by the cut-outs of the plurality of inner-most panels of the opposing side panels of the container.

3. The dispensing assembly of claim 1, wherein the base panel comprises one or more lines of weakness configured to bend as the base panel is biased towards the top panel of the container.

4. The dispensing assembly of claim 1, wherein the base panel comprises one or more rounded corners.

5. The dispensing assembly of claim 1, wherein the one or more notches of the base panel comprise a plurality of notches configured to receive the flexible member.

6. The dispensing assembly of claim 5, wherein the plurality of notches comprise at least one of the following cross-sectional shapes: L-shaped, square, triangle, or rectangle.

7. The dispensing assembly of claim 1, further comprising a tensioning component coupled with the flexible member below the base panel.

* * * * *